US006457682B2

(12) United States Patent
Anderson et al.

(10) Patent No.: US 6,457,682 B2
(45) Date of Patent: Oct. 1, 2002

(54) AUTOMATED RAILROAD CROSSING WARNING SYSTEM

(75) Inventors: Kurt Anderson, Fort Worth, TX (US); Matt Ablett, Smyrna, GA (US)

(73) Assignee: Railroad Controls LLC, Fort Worth, TX (US)

( * ) Notice: Subject to any disclaimer, the term of this patent is extended or adjusted under 35 U.S.C. 154(b) by 0 days.

(21) Appl. No.: 09/732,653

(22) Filed: Dec. 6, 2000

Related U.S. Application Data

(60) Provisional application No. 60/169,444, filed on Dec. 7, 1999.

(51) Int. Cl.[7] ..... B61L 13/00
(52) U.S. Cl. ..... 246/292; 246/294
(58) Field of Search ..... 246/111, 113, 246/270 R, 292, 293, 294; B61L 23/00, 1/00, 13/00

(56) References Cited

U.S. PATENT DOCUMENTS 3,758,775 A * 9/1973 Hopkins ..... 246/125
3,838,271 A 9/1974 Ackard et al. ..... 246/125
3,867,719 A * 2/1975 Perrin ..... 340/902
4,090,685 A * 5/1978 Pappas ..... 246/125
4,108,405 A * 8/1978 Gibson ..... 246/125
4,942,395 A * 7/1990 Ferrari ..... 340/907
5,620,155 A 4/1997 Michalek ..... 246/121
6,157,322 A * 12/2000 Anderson ..... 340/903

FOREIGN PATENT DOCUMENTS

JP 04201678 7/1992 ..... B61L/29/30

* cited by examiner

*Primary Examiner*—S. Joseph Morano
*Assistant Examiner*—Robert J. McCarry, Jr.
(74) *Attorney, Agent, or Firm*—Gardere Wynne Sewell; Sanford E. Warren, Jr.; Daniel J. Chalker

(57) ABSTRACT

An automated railroad crossing warning system includes a controller for servicing the intersection of a railroad track and a roadway with directional horns oriented in opposite directions to direct horn blasts along the roadway is disclosed. A controller detects the presence of a train approaching the intersection and transmits a signal to the horns to activate the horns. A horn detector transmits a signal to the controller upon activation of the horns at a predetermined decibel level. The controller then activates the light such that the railroad engineer can visually determine that the horns at the intersection are being activated. The controller includes an electronic circuit which causes the horns to produce blasts in a predetermined sequence which matches the conventional signal produced by a train engine upon approaching such a crossing.

28 Claims, 14 Drawing Sheets

XI-1
Health Vital Output
R3
10, 1W
D1
15v
C5
47uF
XI-5
VCC
Health Verify In
4.7K
RNIE
OK9A
PS2702-2SM
R35
3.3K
BR2
Bridge
PC1
POTCORE
R12
22, 1W
+VB
FDN34OP
Q1
GND2
IC11B
74HC08
IC11A
Health Out A
Health Out B
Vital SqWave
XI-6
Blow Confirm Vital Output
R41
D3
C5
47uF
XI-7
Blow Cnfm Verify In
OK9B
R42
3.3K
BR1
PC2
R43
Q2
GND
IC11D
IC11C
Blow Cnfm/Strobe Out A
Blow Cnfm/Strobe Out B
K1
1052
D16
IN4004
S2
X1-10
Strobe Contact Closure Output
S1
K1
W237-11P
X1-11
Strobe Verify In
D2
RNIH

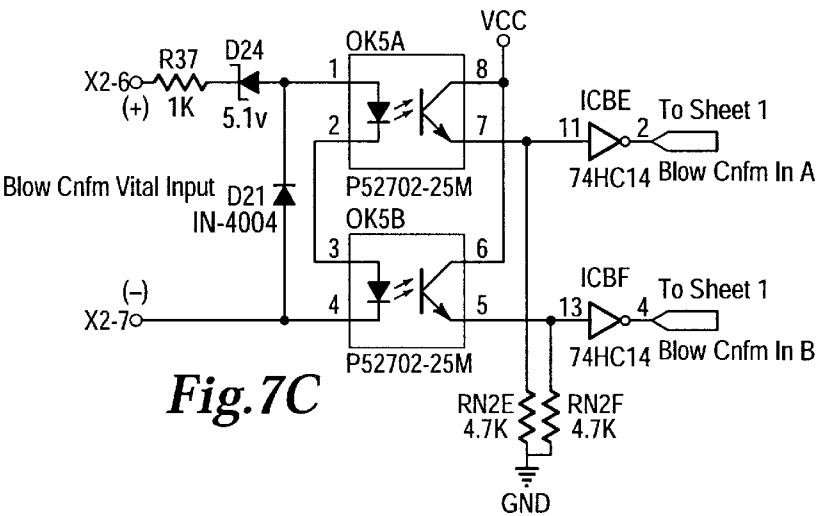
Fig. 7C
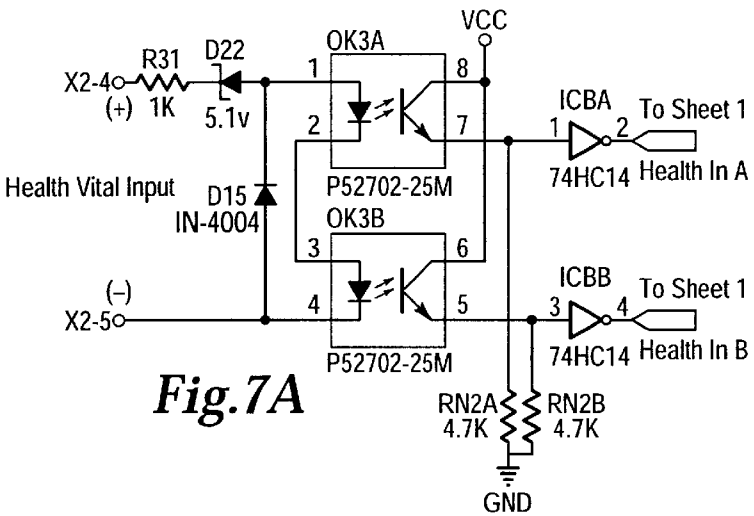
Fig. 7A
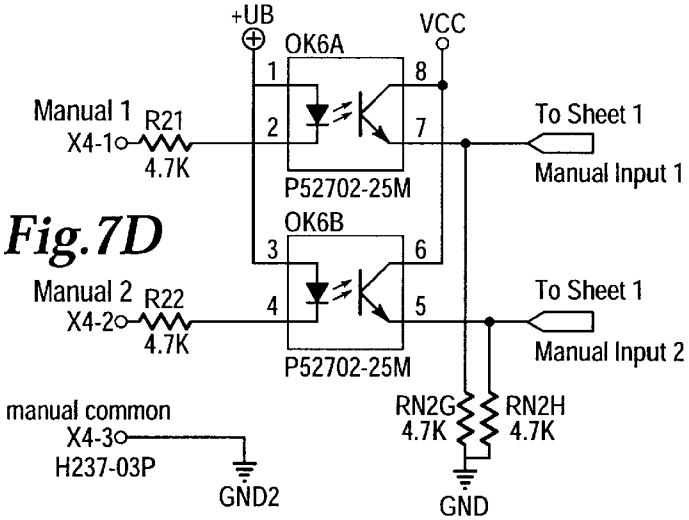
Fig. 7D
Fig. 7B

AUTOMATED RAILROAD CROSSING WARNING SYSTEM

RELATED APPLICATIONS

This patent application claims the benefit of the filing date of provisional patent application serial No. 60/169,444 filed on Dec. 7, 1999.

FIELD OF THE INVENTION

The present invention relates to railroad crossing warning systems and, more particularly to, an improved warning system which provides management and control of directional audible horns located at a railroad intersection for directing sound along an intersecting road, while minimizing or omitting the need for horn blasts from an approaching locomotive.

BACKGROUND OF THE INVENTION

Grade crossings, where motor vehicle traffic crosses railroad tracks, have been a notorious site for collisions between the motor vehicles and trains. Various types of warning systems to warn road traffic of the approach of the train, rely on two major warning sources, specifically, an audible signal from a locomotive horn or a visual indicator of the location of the railroad crossing or both.

While the visual indicator at the railroad crossing varies from a pair of cross-bucks to fully automated crossing gates with lights and bells, the first part of the equation continues to rely on the timely occurrence of horn blasts from the locomotive. Since the driver of the motor vehicle must have enough time to stop at the crossing in response to a warning signal, the horn blast from the locomotive must occur at a sufficient distance from the grade crossing. To produce a sound of adequate intensity to be heard by the driver, while the locomotive is still approaching the intersection, the horn blast must be activated at a very high decibel level.

One problem associated with horn blasts on a locomotive is the disturbance to residents in the area located adjacent to the rail corridor. A related but less common problem occurs when a train is backing over a crossing, wherein the horn is located on the opposite end of the train.

It would, therefore, be desirable to have an improved railroad crossing warning system that does not require or only rely upon the horn blasts from a locomotive approaching the intersection as a means of providing a warning to highway traffic that a track-based vehicle is approaching.

SUMMARY OF THE INVENTION

The automated railroad crossing warning system of the present invention includes a controller housed and mounted at the railroad track intersection with directional audible alarms oriented on each side of the track and facing in opposite directions along the intersecting roadway in order to direct warning blasts along the roadway, generally transverse to the railroad track. A confirmation signal such as a strobe light may be mounted on a housing, or remotely, for viewing by an approaching railroad engineer. The confirmation signal serves as an indication to the engineer that the warning system is operating properly. A detector senses the presence of a train approaching the intersection and transmits a signal to a controller that activates the audible alarms. A sound detector is used as part of a fail safe circuit. It transmits a signal to the controller upon activation of the horns at a predetermined decibel level. The controller then activates the confirmation signal so that a railroad engineer can visually determine that the warning system at the intersection is operational.

The present invention comprises an audible alarm located at the intersection of the railroad track and roadway that produces a directional audible signal in opposing directions along a roadway, a visual indicator co-located with the audible alarm for visually indicating to an approaching track-based vehicle of the activation of the audible alarm at predefined operational levels. A controller is connected to the audible alarm and the visual indicator. The controller receives signals from transducers located along the railroad track that detect the approach of a track-based vehicle towards the intersection at predetermined locations along the railroad track. The controller activates the audible alarm in response to the signals. The controller also monitors the operation of the audible alarm at predefined operational levels and transmits a signal to the visual indicator in response thereto. The controller may also detect the proper operation of the visual indicator and record system operation.

The controller further comprises a plurality of inputs for managing a plurality of independent transducers or transducer triggering events. The controller, through the plurality of inputs, can provide multiple railroad track monitoring capabilities. The controller generates audible signals in response to the independent transducer triggering events. The alarm assembly is mountable at an intersection such that alarms and visual indicators can be separately oriented to direct audible signals along the intersecting roadway, generally transverse to the railroad track, and the visual indicator along the railroad track, generally towards the direction of approaching track-based vehicles. The visual display may include a means for masking the visual display from viewing in directions transverse to the railroad track. The audible alarm, visual indicator and controller are modules that may be integrated into an assembly.

The controller can produce a predetermined sequence of horn blasts upon activation of the alarm. The sequence of the horn blast can resemble the sound typically associated with the horn of an approaching locomotive. Alternatively, a variety of audible signals can be recorded in memory within the system for access by the controller.

The controller, having a plurality of inputs for receiving signals from a plurality of remote transducers, may be connected, directly or indirectly, to the plurality of transducers located at a single or multiple points along a railroad track. The transducers can detect an approaching locomotive or other track-based vehicle. Detecting may be based on weight or sight. Under this configuration the controller activates the alarm in response to its detection of signals from the tranducers. The controller may also activate the audible alarm at predefined operational levels based on transducer inputs to the controller. Such transducer-based management can allow for audible alarms of various amplitude, frequency and duration, based upon transducer-related input to the controller. With such a scheme, the controller can provide a signal to the visual indicator in accordance with the appropriate tranducer-related audio signal being produced. Audio monitoring is provided by a sound detector with input to the controller.

Proper operation of the system, including the alarm, the visual indicator, the sound monitor and the inputs, can be monitored by a microprocessor-based controller. Operation of the system can be recorded in memory by the controller. The controller may automatically adjust the audible alarm to produce the appropriate amplitude of the audible alarm at predefined levels.

The present invention also includes a method of providing advanced audible warning at the intersection of a railroad track and roadway that comprises monitoring a plurality of controller inputs for input signals based on remote transducer activation, wherein the input signals are a result of activation of a plurality of transducers located along a railroad track, activating an audible alarm at predefined operational levels based on the signal input to the controller, the input indicating the approach of a railroad vehicle towards the intersection, transmitting a signal to a visual display indicator in response to activation of the audible alarm at predefined decibel levels and recording system operation.

BRIEF DESCRIPTION OF THE DRAWINGS

For a more complete understanding of the present invention, including its features and advantages, reference is now made to the detailed description of the invention, taken in conjunction with the accompanying drawings of which:

FIG. 7 is an electrical schematic diagram of a portion of the circuitry of the control unit;

DETAILED DESCRIPTION OF THE INVENTION

While the making and using of various embodiments of the present invention is discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the invention.

Figure 1:
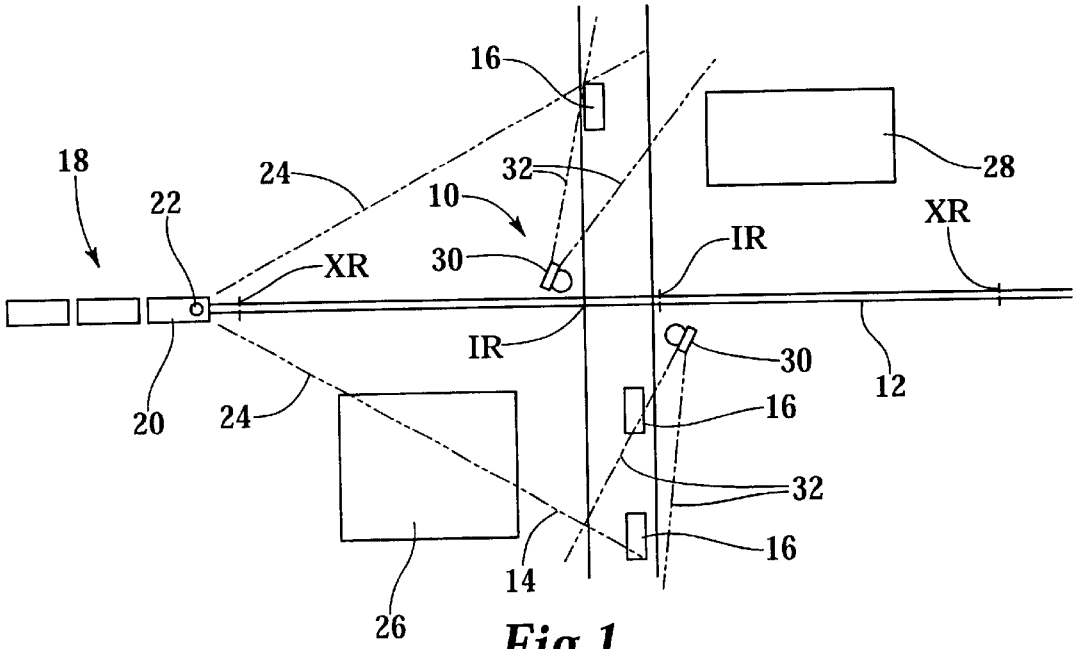
FIG. 1 is a site plan of a conventional grade crossing showing the warning system of the present invention.

Referring now to the drawings and more particularly to FIG. 1, a railroad grade crossing is generally designated 10 with the railroad tracks 12 and a road 14 oriented generally transverse to tracks 12 with automobiles 16 thereon. A train 18 on tracks 12 includes a locomotive 20 with a horn 22 mounted thereon.

As shown in FIG. 1, the locomotive horn 22 has a generally triangular area bounded by lines 24 over which the loudest portion of the horn sound will travel. In order to alert automobiles 16 with sufficient time to stop prior to crossing tracks 12, the locomotive horn 22 must be sounded at a predetermined distance from crossing 10 such that lines 24 extend a sufficient distance outwardly from track 12 on road 14. FIG. 1 clearly shows that the sound area 24 will encompass buildings 26 and 28 on both sides of track 12 in addition to large expanses of area bounding track 12.

The warning system of the present invention may consist of a pair of control units 30 located at crossing 10 with a directional sound area designated generally by lines 32. It can be seen that sound areas 32 are directed generally transverse to the tracks 12 so as to generally follow the road 14, outwardly from track 12. Thus, the sound areas 32 may be more narrowly confined so as to avoid directly covering surrounding buildings, such as buildings 26 and 28.

Figure 2:
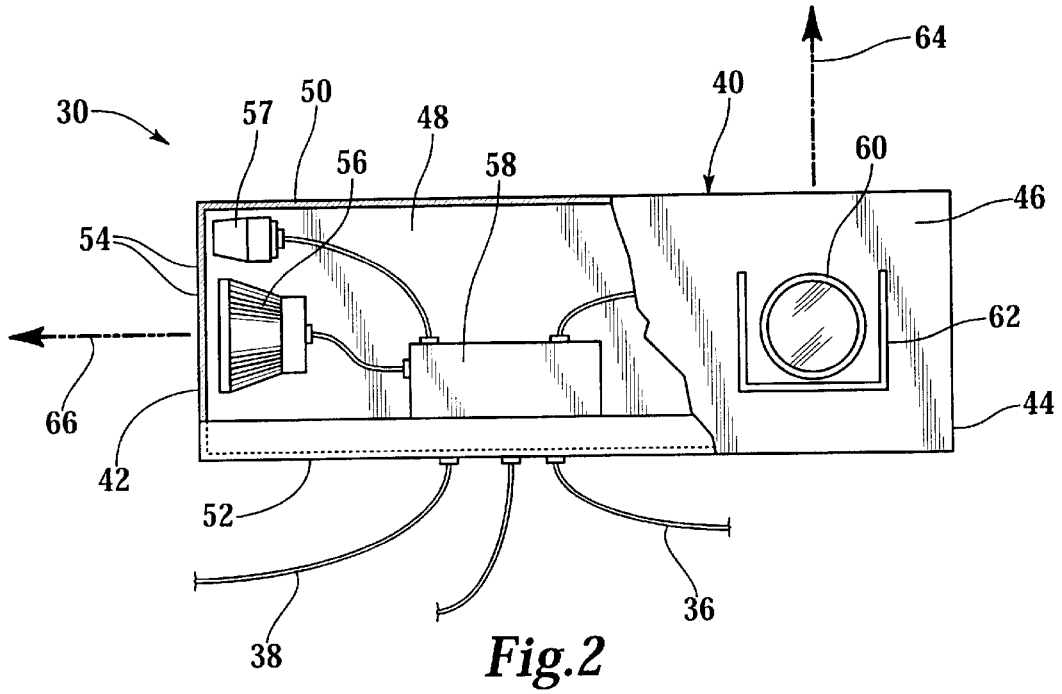
FIG. 2 is a partially broken away top plan view of a control unit of the present invention.

Referring to FIG. 2, an integrated layout of the present invention is illustrated. Within the illustrated system, each control unit 30 may include an enclosed housing 40 having a forward end 42, a rearward end 44, top and bottom 46, 48 and side panels 50, 52. Forward end 42 includes perforations 54 to permit sound from a horn 56 to project outwardly from housing 40. Horn 56 is electrically connected to a control box 58 within housing 40. A horn detector 57 mounted in housing 40 detects the sound of horn 56, as described in further detail below.

A strobe light 60 or other confirmation signal is mounted on the top 46 of housing 40 and has a blinder plate 62 extending around three sides thereof such that light is directed generally in a single direction outwardly as indicated by arrow 64. Sound from horn 56 is generally directed along arrow 66, in a direction generally transverse to that of arrow 64, as described hereinbelow.

A power line 36 is connectable to control box 58 and supplies power to the controller circuitry therein. It should be appreciated that power may be supplied from alternate sources such as utilities, battery, solar, etc. Signal line 38 also enters housing 40 through side panel 52 and is connected to control box 58.

Figure 3:
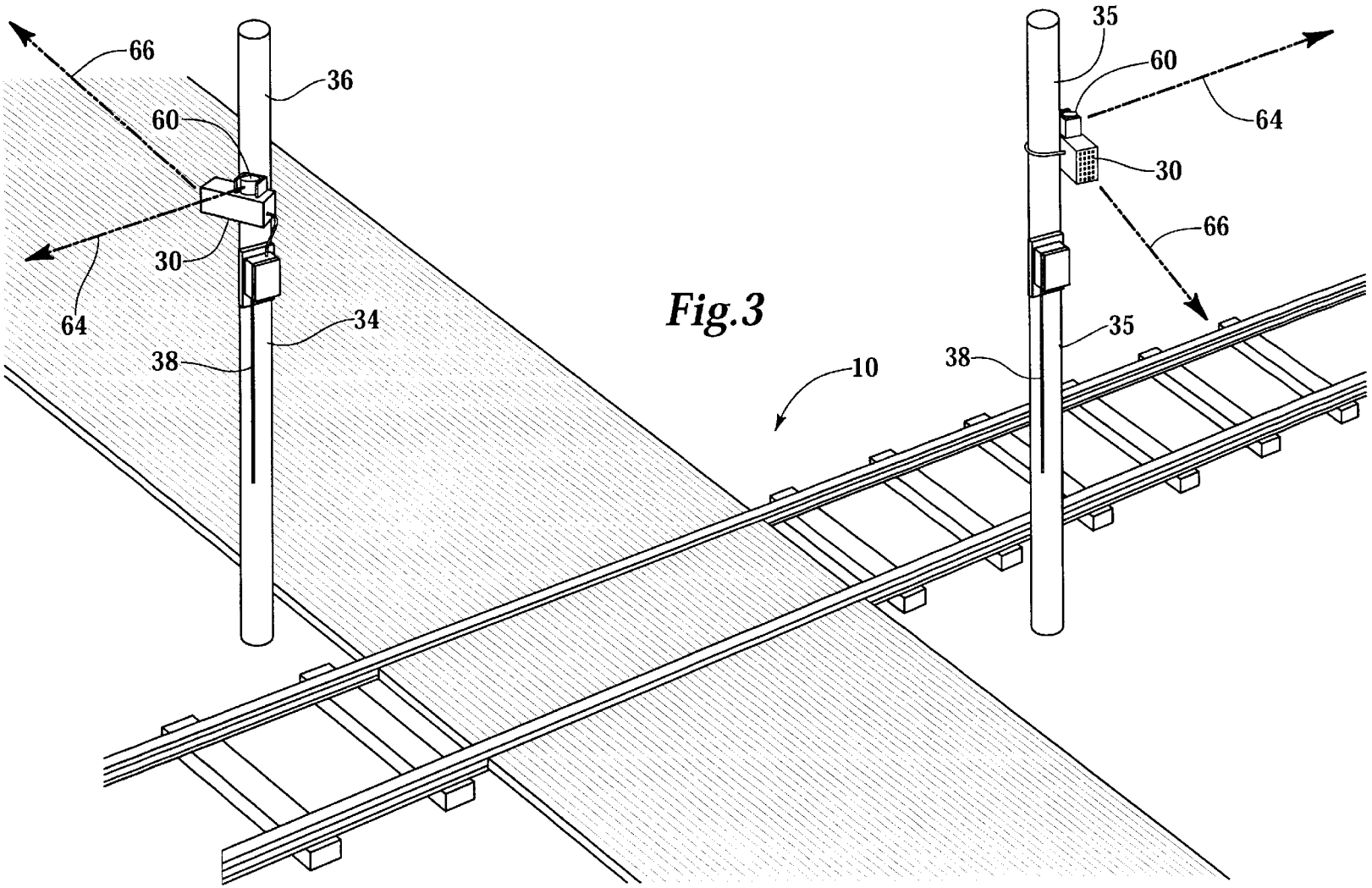
FIG. 3 is a pictorial view of two control and alert units mounted on poles at a grade crossing site.

Referring now to FIG. 3, a pair of control units 30 are each shown mounted on respective upright poles 34, 35 which are preferably located adjacent to crossing 10. Use of at least two control units 30 is envisaged based on the normal two-way intersection design. It is, however, conceivable that a single control unit 30 can be manufactured to provide for multi-directional operation from a single pole. Additional control units 30 may also be required to provide warning for adjacent roadways. Under a two unit scenario, poles 34, 35 each include a power line 36 which supplies electrical power to units 30. A signal line 38 provides the appropriate triggering signals, as described in more detail hereinbelow, to units 30.

Units 30 are mounted on poles 34, 35 such that strobe lights 60 are directed as indicated by arrows 64 and 64', in opposite directions along the railroad tracks. Similarly, the alarm sound directions, indicated by arrows 66 and 66' are oriented to direct the sound in opposite directions along the intersecting roadway. In this way, lights 60 may be viewed by the locomotive engineer approaching the crossing 10 from either direction and roadway vehicles approaching from either direction will receive ample audio warning of an approaching locomotive before arriving at the intersection. In some locations, placement of additional confirmation signal systems, such as strobe lights on the railroad approach may be used to ensure visibility by the train crew.

Figure 4:
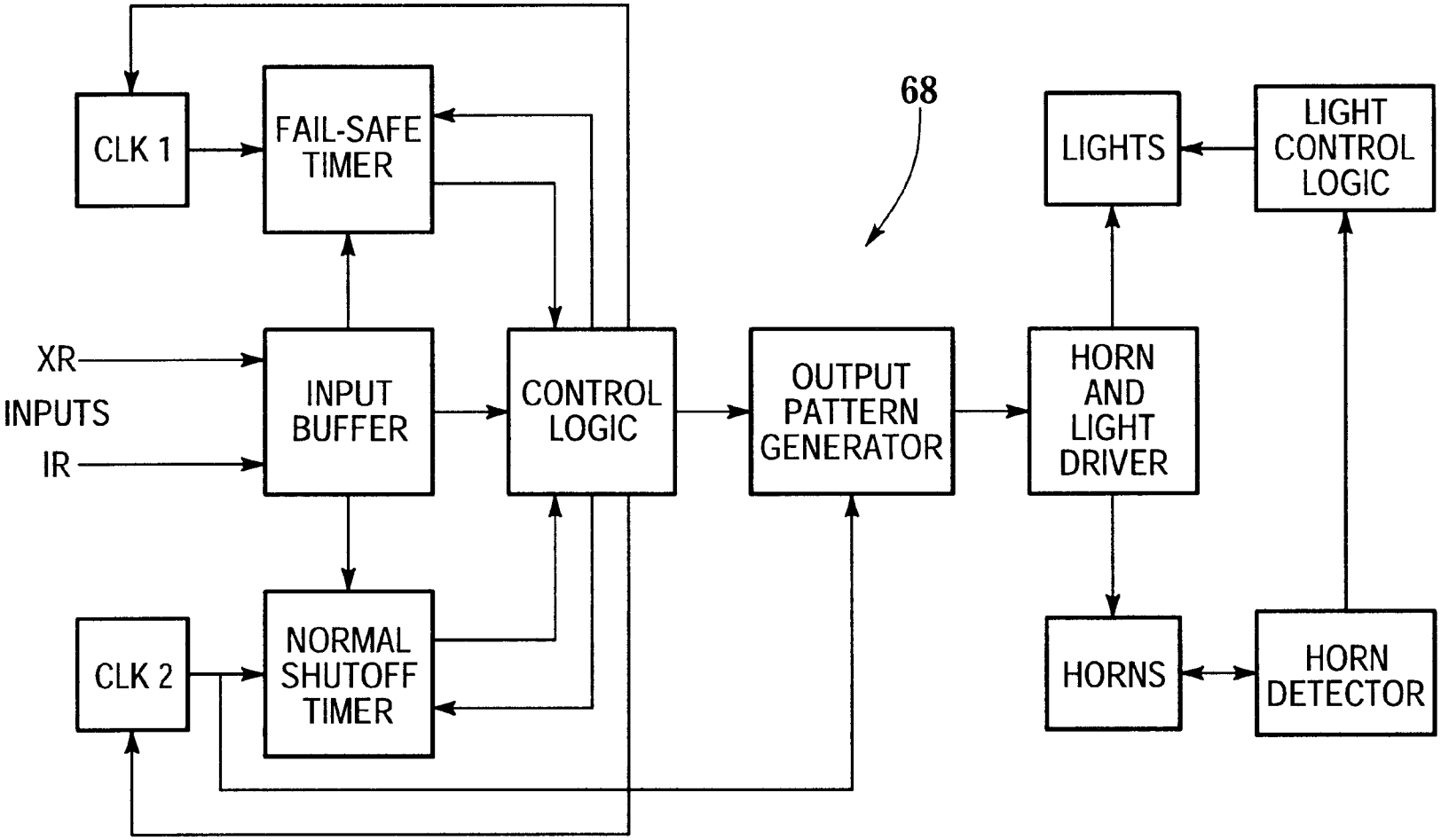
FIG. 4 is block diagram of system components of the present invention.

Referring now to FIG. 4, the block diagram shown describes system control circuitry. There may be as few as two signal inputs to the control circuit 68, as shown in FIG. 4, which are activated by a locomotive approaching a grade crossing warning system. For the purpose of simplifying the following description regarding operation of the invention, two signals, XR and IR, will be described. Crossing Relay signal "XR" becomes active when the locomotive crosses into a block defined by XR and XR' shown in FIG. 1. Conventionally, a crossing circuit exists between XR and XR' located an approximate distance before the crossing 10, although multiple circuits can be placed in overlapping locations along each direction of the track. The second signal input is an Island Relay signal "IR" which is activated when the locomotive crosses into the block bounded by IR and IR' of FIG. 1. Preferably, IR and IR' are located within 50 feet of the crossing 10. As shown in FIG. 2, input signals XR and IR are transmitted over signal line 38 to control box 58 and control circuit 68 therein.

As shown in FIG. 4, signals from XR and IR inputs are first buffered. The input buffers form a time delay circuit to avoid false triggering caused by voltage spikes on the inputs, and limit the input current. After the input buffer, the XR and IR signals are passed to the control logic circuit for further processing. When the control logic circuit receives an "ACTIVE" signal from the XR input and an "IDLE" signal from the IR input, this combination indicates that a locomotive is approaching the crossing and that the warning horns should be sounded. The control logic then switches to an active mode which passes a signal to the output pattern generator. The output pattern generator produces a signal which will cause the horn to sound in a pattern which imitates that utilized by locomotives to indicate the approach of a train towards a crossing. More specifically, this signal includes two long blasts, a short blast and a long blast.

A signal from the output pattern generator is passed to the horn and light driver, which operate the horn to produce the warning sound, as well as a strobe light to indicate the proper operation of the horn. As noted above, when activated, the horn and light driver will pass a signal to the horns, according to the pattern received from the pattern generator, and will pass a signal to the lights, to activate both the horn and lights. The light is utilized to provide an indicator to the locomotive engineer that the horns are blowing at the crossing. A horn detector will detect the operation of the horn and pass a signal to the light control logic. The light control logic determines whether the sound from the horn is of a predetermined magnitude. If the magnitude is sufficient to surpass a predetermined threshold, the lights are permitted to be activated by the horn and light driver. If the horn is either off or not of sufficient magnitude to meet a predetermined threshold, the light control logic will not permit the lights to operate. If the lights fail to activate upon the approach of a locomotive, the engineer will see that the horns are not being activated and can then blow the locomotive-based horn to provide adequate warning at the crossing.

Referring again to FIGS. 1 and 4, the movement of locomotive 20 into crossing 10 will activate the IR input while the XR input is still active. This combination indicates that the locomotive has reached crossing 10 and that the warning horns may cease. The control logic then enters a "WAIT" mode wherein the horns will continue to blow in the same pattern for approximately five seconds and then shut off until a change in the inputs occurs.

As the train proceeds through the crossing, and leaves the IR block, the IR input signal changes to "IDLE" or "INACTIVE" while the XR signal remains active. This combination indicates that the train has cleared the crossing. At this point, the circuit enters the "check back" mode and waits approximately five seconds to determine whether there is a change to the XR input. If the XR input becomes inactive, this indicates that there are no more trains approaching, at which time the circuit enters a "STAND-BY" mode. On the other hand, if the XR input remains active after the five second interval, this indicates that another locomotive is approaching, such as at multiple track crossings and the circuit will again enter the "ACTIVE" mode.

The fail safe timer, shown in FIG. 4, is utilized in situations where the XR input signal is falsely activated and remains activated due to a malfunction. Without the fail safe timer, the circuit 68 would remain in the active mode, and thereby continue to sound the horns. The fail safe timer is adjustable from approximately two to four minutes and would cause the circuit to enter a "fail safe" mode wherein the horns are silenced. The circuit would remain in this mode until the circuit re-enters the "STAND-BY" mode by returning the XR and IR inputs to the idle or inactive condition. The control logic also includes a "WAIT" mode which is enabled when an active signal is received from the IR input while the XR input remains inactive. The wait mode maintains the horn and lights in the deactivated condition.

The present system is designed to combine the functionality of a control module, sound generator/amplifier module, and sound detector module together with warning indicators. All modules may reside on a single printed circuit board and all functions may be managed by a single programmable microprocessor. The one exception to component co-location will typically rest with the power transformer, which is required for the audio amplifier circuit and warning lights. This transformer must be mounted in a convenient location adjacent to the circuit board. The majority of the board components are surface-mount devices that minimize board size while maximizing board reliability.

The following description provides a more detailed description of an embodiment of the invention wherein individual subsystem componentry and their respective function performance is described. It should be appreciated by those skilled in the art that a programmable microprocessor-based system can be employed to carry out the methods of the present invention. The circuitry description by itself does not describe the only mode of implementing the advanced warning system of the present invention, but provide detail operational steps accomplished by a system configured to overcome the shortcomings in the art. Software execution within a microprocessor-based system can provide the operational steps required for successful advanced warning according to the method of the invention, and should be considered after understanding the following detailed description.

The vital controller translates a vital horn control input into a series of horn control sequences, generates an amplified audio horn signal to the speaker and verifies via a separate detection circuit that the horn is blowing at the proper sound level. In addition, the controller can provide a daisy chain connection, whereby a single controller is configured as a master to control any number of like systems with controllers configured as slaves.

Figure 5A:
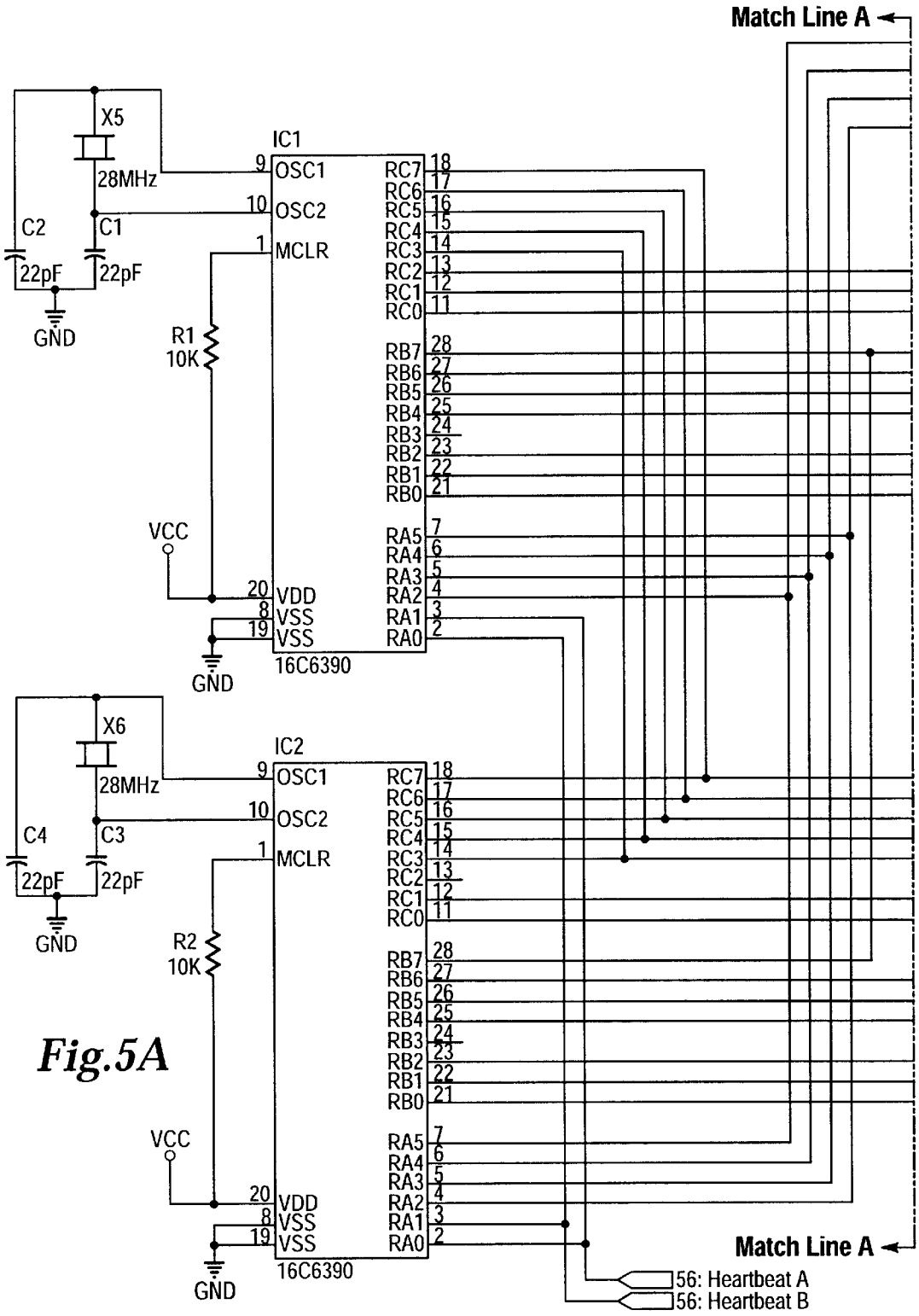
FIG. 5 is an electrical schematic diagram of a portion of the circuitry of the control unit.
Figure 5B:
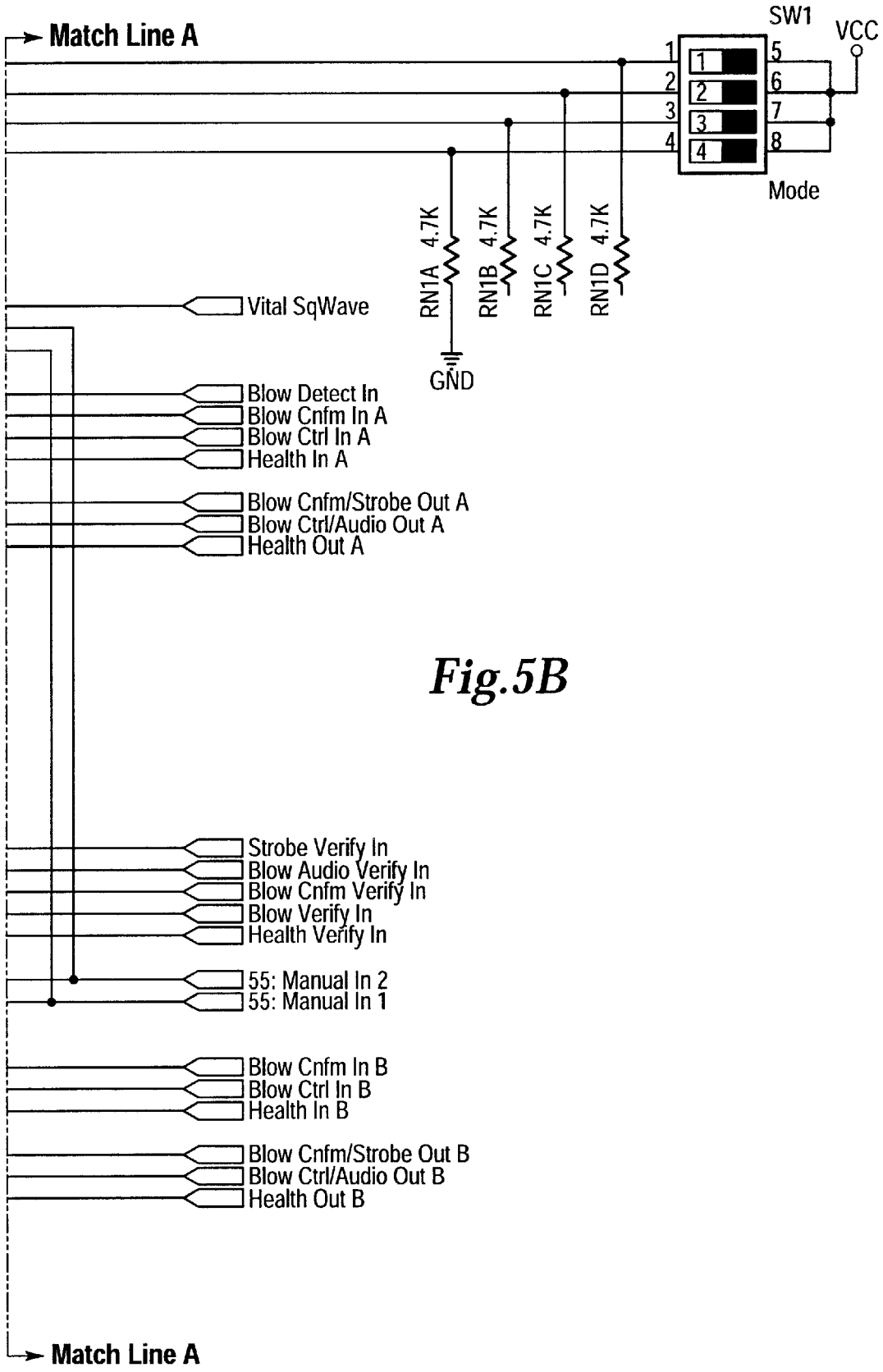

Referring to FIG. 5, CPU circuitry is shown for carrying out the present invention.. The illustrated controller is a pair of "Microchip PIC16C63A" microprocessors working in tandem. The microprocessors contain identical firmware and are synchronized with each other for proper operation. All memory, address decoding, timers and reset circuitry are contained within the processor chip for reduced hardware requirements. The support circuitry consists of the crystal with a pair of capacitors tied to the OSCI and OSC2 pins and a pull-up resistor for the external line, MCLR. No additional reset or monitoring circuitry would be required due to the design of the PIC16C63A. It contains internal power-up and brown-out detection circuitry that holds the processor in reset any time the input voltage is below an operable threshold. Upon application of the proper voltage, an internal timer delays processor start-up to allow power supply stabilization. An internal hardware watchdog circuit prevents erroneous operation by forcing a processor reset if software does not perform the proper operations on a periodic basis. The remainder of the PIC16C63A interface consists of 22 user-programmable inputs and outputs. The horn board uses 16 inputs and 5 outputs, with one unused I/O pin. The following table describes the inputs and outputs:

| I/O | Direction | Usage |
|---|---|---|
| RA0 | Output | CPU Sync Out |
| RA1 | Input | CPU Sync In |
| RA2–RA5 | Input | Mode dip switches |
| RB0–RB2 | Outputs | Vital outputs |
| RB3 | Input | Unused |
| RB4–RB6 | Inputs | Vital Inputs |
| RB7 | Input | Horn Audio Detector Input |
| RC0–RC1 | Inputs | Manual/Police Panel inputs |
| RC2 | Output | Vital Output Square Wave Driver |
| RC3–RC7 | Inputs | Verifies for vital and horn output circuitry |

Figure 6:
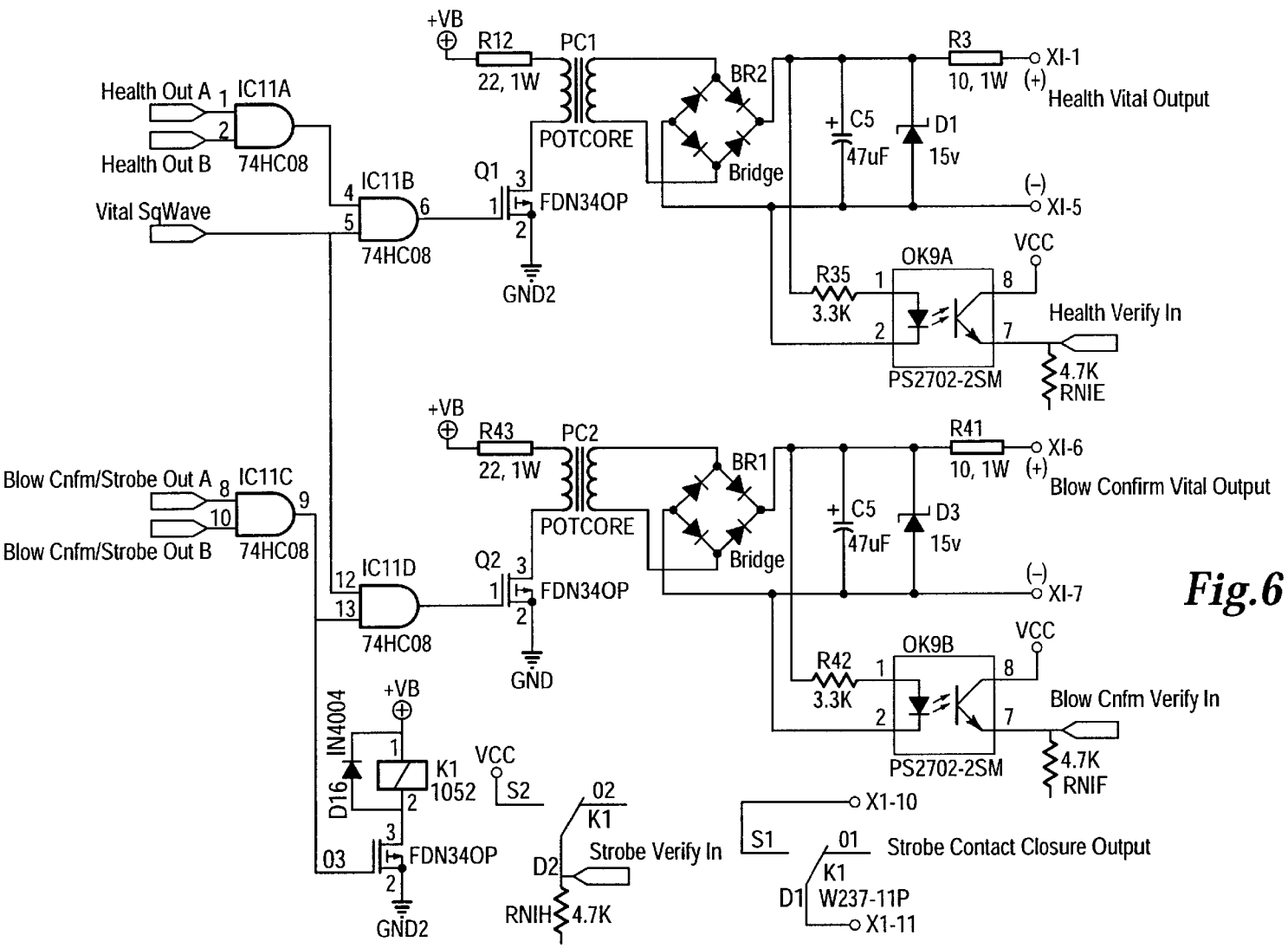
FIG. 6 is an electrical schematic diagram of a portion of the circuitry of the control unit.

The Vital Input circuitry is shown generally in the schematic diagram illustrated in FIG. 6. For component references, the "Health Vital Input" circuit of FIG. 7 will first be discussed. The standard RCL vital input circuit is encountered. By using redundancy on the key components, the failure of any one component will result in a "false" input indication. The hardware and firmware are designed so that "false" indications are detected as the fail safe state. Each vital input is designed to generate a "true" or active signal when the input voltage rises above about 8 VDC. The circuit is designed to operate with continuous input voltages between 8 VDC and 16 VDC, based on the nominal 12 VDC railroad equipment.

The vital input voltage drives the two optocouplers (OK3A and 0K3B) to generate an isolated input signal. Resistor R31 and zener diode D22 provide the necessary current limiting and voltage threshold functions. D22 prevents any current flow through the circuit unless the input voltage exceeds 5.1 volts. Once that threshold is exceeded, R31 limits the current flow. A number of factors, such as component tolerances and temperature, affect the turn-on point of the optocouplers.

The supplied values guarantee that the vital input cannot turn on below 6 VDC (due to D22) and are always on at 9 VDC. Diode D19 prevents damage to the optocouplers in the event of reverse polarity on the input. The output side of the optocouplers are used to drive the logic-level circuitry. When the vital input voltage is below the turn-on threshold level, the pull-down resistors (RN2A, RN2B) keep the logic signal at ground level. When the vital input voltage increases, the optocoupler output transistors begin to conduct, pulling the signal towards Vcc. Due to the nature of optocouplers, the output voltage rises gradually when the vital input voltage is between 6 VDC and 9 VDC. Schmidt trigger buffers (IC8A and IC8B) are used to clean the output of the optocouplers and provide a consistent drive current for the remainder of the logic-level circuitry. The vital input circuitry, therefore, consists of two identical paths, each providing a logic-level input to one of the processors. If either input circuit path fails, the circuit, processors and board fall into a fail safe operational state.

Non-vital mode switch circuits are shown on the horn schematics in FIG. 5. The manual inputs are shown in FIG. 7. In addition to the vital input circuitry, there are some non-vital inputs on the board. These inputs include the mode dip switches and the manual (police panel) inputs as shown in FIG. 5. The dip switches are used to select the operating mode of the horn board. These are contained in a single 4-pole switch (SW1) tied directly to four inputs of each processor. A closed switch drives the input up to Vcc, while the pull-down resistors RN1A, RN1B, RN1C and RN1D ensure that an open switch results in a grounded input level.

The manual inputs are designed to be wired to either two police panel toggle switches or to the opposite contacts of a single-pole, double-throw "Center OFF" type switch. A manual common signal provides a ground reference. Each input activates an optocoupler (OK6A and OK6B) when grounded to the manual common signal. The output of each optocoupler provides a logic-level signal indicating the state of the corresponding manual input.

Figure 8:
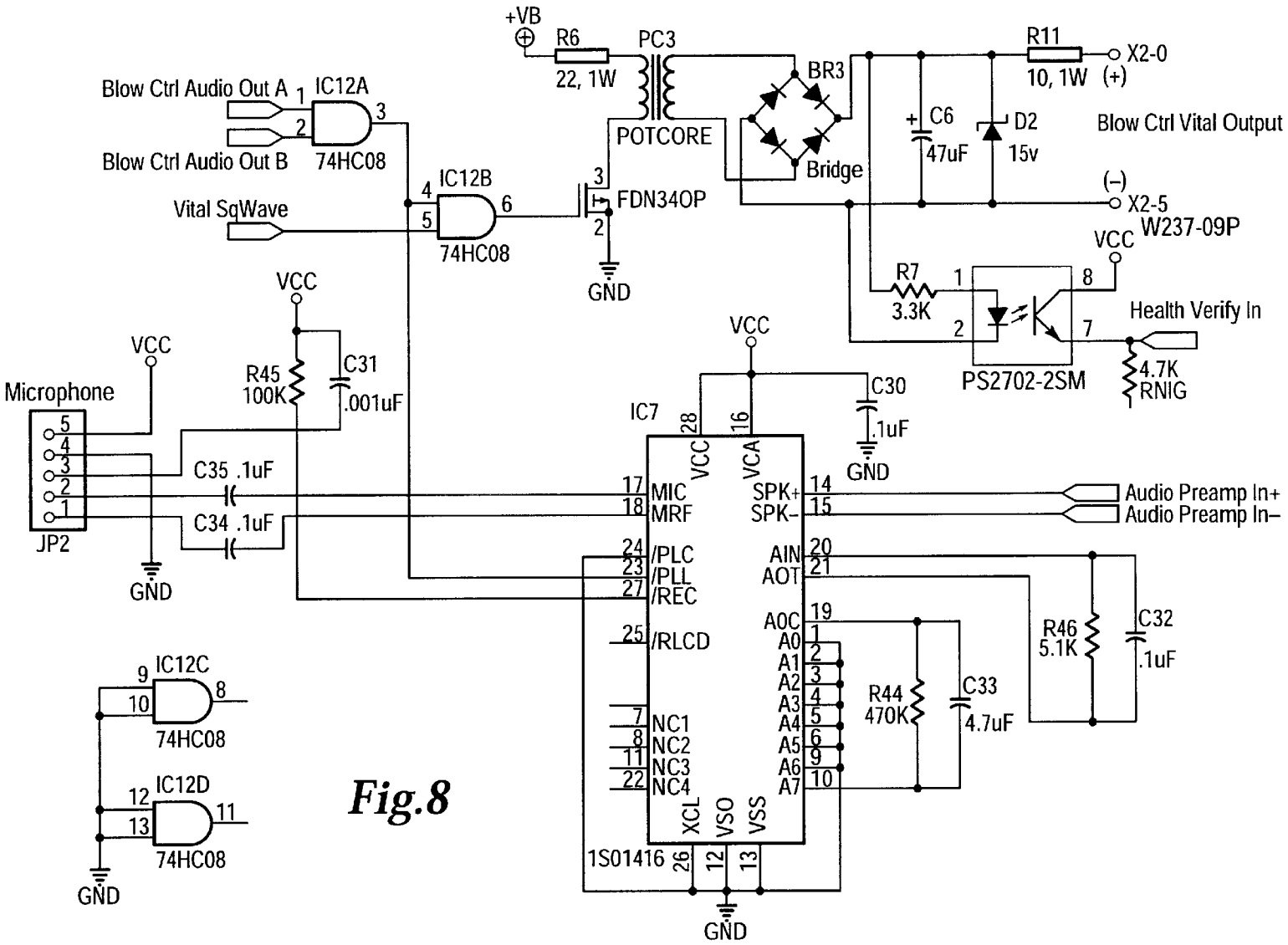
FIG. 8 is an electrical schematic diagram of a portion of the circuitry of the control unit.

Vital output circuitry is shown on the horn schematics, FIGS. 6 and 8. For component references, the "Health Vital Output" circuit of FIG. 6 will be described. A standard RCL vital output circuitry is used. The design of the vital output requires active manipulation of the circuit in order for the final output voltage to be generated. A failure in any component will result in a steady-state circuit which will cause the vital output voltage to drop. The heart of the vital output circuit is an isolated "DC-to-DC Converter" circuit.

The processors provide a logic signal to activate each vital output, and a "vital square wave" signal to drive the DC-to-DC converter. IC11A and IC11B are used to provide a square wave output any time both processors drive the health outputs (Health Out A and Health Out B) high. The output of IC11B is used to gate the power MOSFETQ1. The MOSFET is used as a high-current switch, with a very low current gate signal. Transformer PC1 is a 2:1 signal isolation transformer. The combination of R12, PC1 and Q1 result in an AC voltage at the secondary of PC1 any time Q1 is gated with the square wave described above. The output voltage is approximately half of the level of +VB, which in this case is 24 VDC.

Bridge BR2 provides full-wave rectification and capacitor C5 smooths the voltages to produce a DC output. Zener diode Dl limits the output voltage to 15 VDC when there is no load on the output circuit. Resistor R3 provides protection against output short circuits. Finally, the vital output voltage level is verified by a separate optocoupled circuit. OK9A and R35 are used to provide a logic-level output when a voltage is present at the output. If any of the vital output circuitry fails, the output voltage will not be present. The processor uses the vital output verify signal to monitor the operation of the vital output circuitry. Note that there is no Schmidt trigger required at the optocoupler output. This is because the vital output voltage rises and falls rapidly through the linear range of the optocoupler, and the resulting output voltage does not change gradually.

The output verify circuitry provides another function by discharging capacitor C5. If the vital output does not have a sufficient load connected to it, C5 would remain charged for extended periods after removal of the vital output control square wave. R35 provides a discharge path so that the vital output voltage drops within 100 milliseconds of the removal of the vital output control square wave.

Figure 9A:
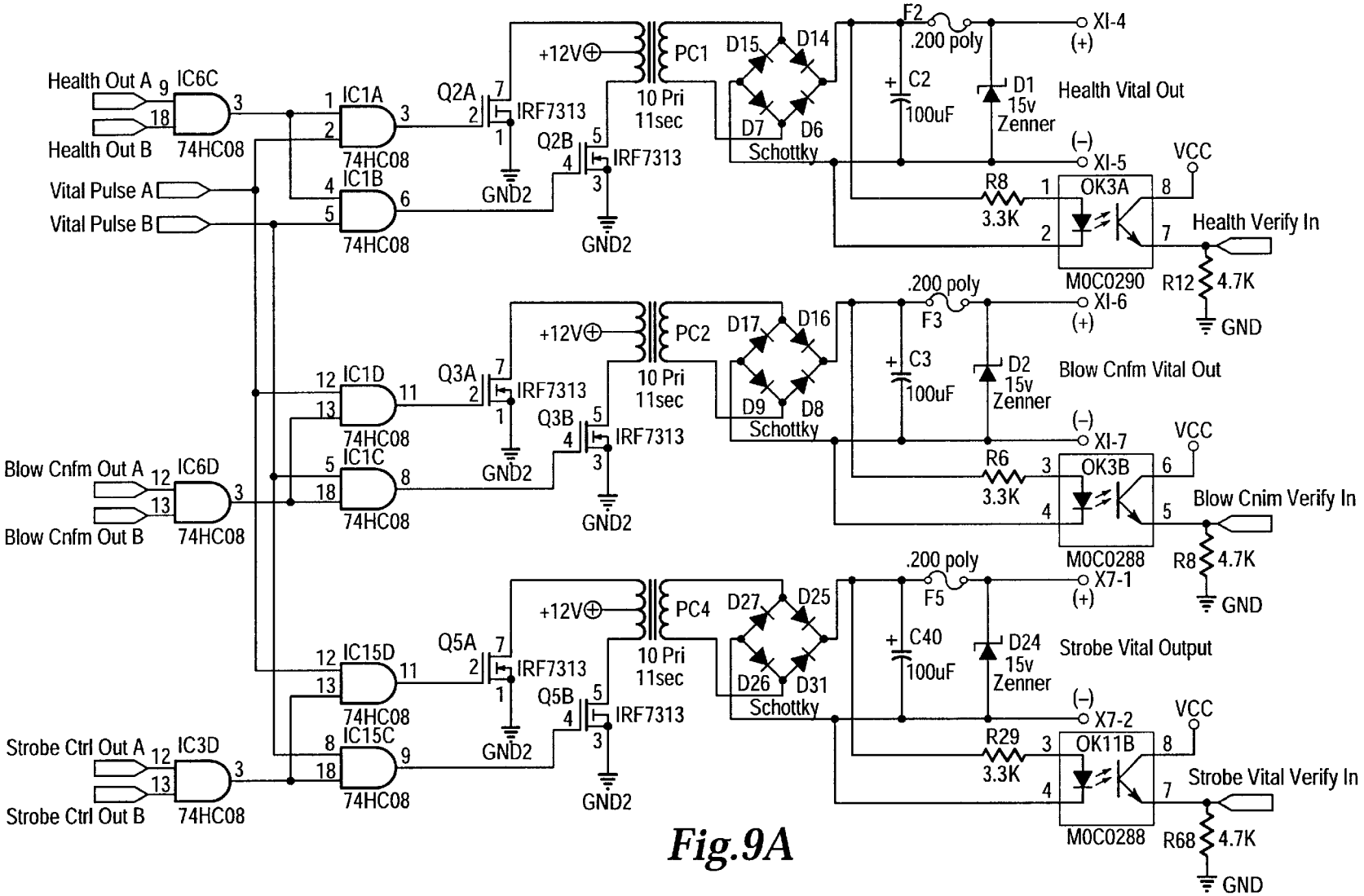
FIG. 9 is an electrical schematic diagram of a portion of the circuitry of the control unit.
Figure 9B:
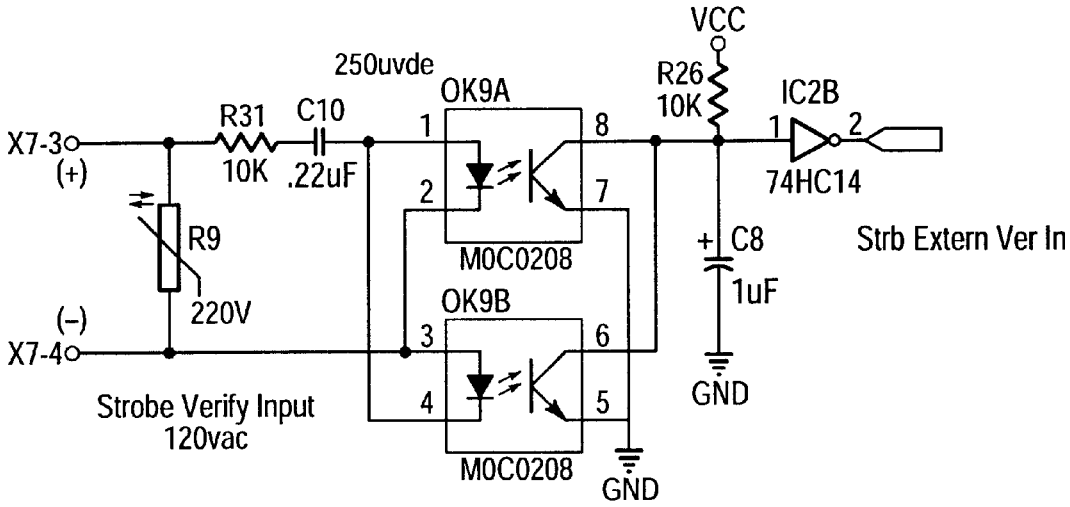

An alternate vital output circuit is shown in FIG. 9. The alternate "Health Vital Output" circuit will be used for component reference. The alternate circuit uses the processor logic signals (Health Out A and Health Out B) and complementary "vital square waves" (Vital Pulse A and Vital Pulse B) to drive the dual-MOSFET DC-to-DC Converter circuit. IC6C, IC1A and IC1B are used to provide alternating complementary square waves to gate the power MOSFETs Q2A and Q2B. Transformer PCl is a 1:1 isolation transformer with a center-tapped primary coil. The 1:1 transformer is used when a 12 VDC voltage is applied to the primary side. If a 24 VDC voltage is used, a 2:1 transfer is used. The dual-MOSFET converter circuit results in a more efficient transfer of power to the vital output.

Strobe output circuitry is also shown in FIG. 6. An output is generated when the horn is blowing and the horn detector is verifying the proper horn operation. A vital output is generated for confirmation, and a "contact closure" output is generated to activate the strobe light. The vital output circuitry operates as described in the vital output circuitry section of this document. The strobe output is driven by the same logic signals as the vital output. The output of IC11C drives both the vital square wave generator and the relay control circuit. MOSFET Q3 is used to convert the constant logic signal to a high-current, high voltage control path for relay K1. Diode D16 prevents inductive voltage spikes during K1 state changes. When activated, K1 generates a contact closure output. K1 is a double-pole relay, with the second pole used for verification. When the relay is energized, the Strobe Verify In signal is pulled to Vcc. When K1 is off, resistor RN1H keeps the Strobe Verify In signal at ground.

An alternate Strobe output circuit is shown in FIG. 9. The "Blow Confirm Vital Output" is separated from the Strobe output so that each may be controlled independently by the microprocessors. The contact closure relay of the Strobe Output is replaced with a vital output driver for higher reliability. With the separation of the Strobe and Blow Confirm outputs, the Blow Confirm output may be used to provide a constant confirmation signal to recorder equipment, while the Strobe output may be pulsed or flashed as desired to operate the strobe lights.

An alternate Strobe Verify circuit is also shown in FIG. 9. A 120 VAC "Strobe Verify Input" is included so that any external equipment required to operate the strobe lights may be monitored. Any time the Strobe output state does not match the Strobe Verify input state, the microprocessors generate a failure condition. Components R31, C10, OK9A and OK9B are used to generate a nominal 5-volt signal whenever 120 VAC is applied to the Strobe verify input pins. R25, C9 and IC2B filter, smooth and clean up the outputs of OK9A and OK9B, producing a logic-level verify signal to the microprocessors. Transorb R9 is used for protection against voltage spikes and surges on the 120 VAC input.

The Sound Generator circuitry is shown in FIG. 8. The controller generates an output to blow the horn in a specified pattern. A vital output is generated to signal any slave boards. The vital output circuitry operates as described in the vital output circuitry section of this document. An adequate sound generator can be found in the ISD1416(IC7). This chip is designed to play back up to 16 seconds of prerecorded audio. When the PLL input is pulled low, IC7 begins audio playback. The playback stops when either the PLL input returns high or when the chip reaches the end of the recorded audio. The ISD1416 allows playback to be "looped" such that an audio output longer than 16 seconds may be achieved. The 16-second limit, however, is maintained in this circuit for failsafe operation. If, for any reason, the controller attempts to blow the horn for longer than 16 seconds, the ISD1416 will. stop the audio output.

The controller will detect the absence of audio feedback and will respond with the appropriate failure condition. The only circuitry required to support IC7 in playback mode are some resistors and capacitors to minimize noise into the audio output. The support circuitry. necessary for recording to the device may be connected via the microphone header pins (JP2). The typical production scenario includes prerecording the horn sound at the manufacturing site. JP2 and external microphone circuitry, however, allows the recording of the audio signal in a post-production environment.

Figure 10:
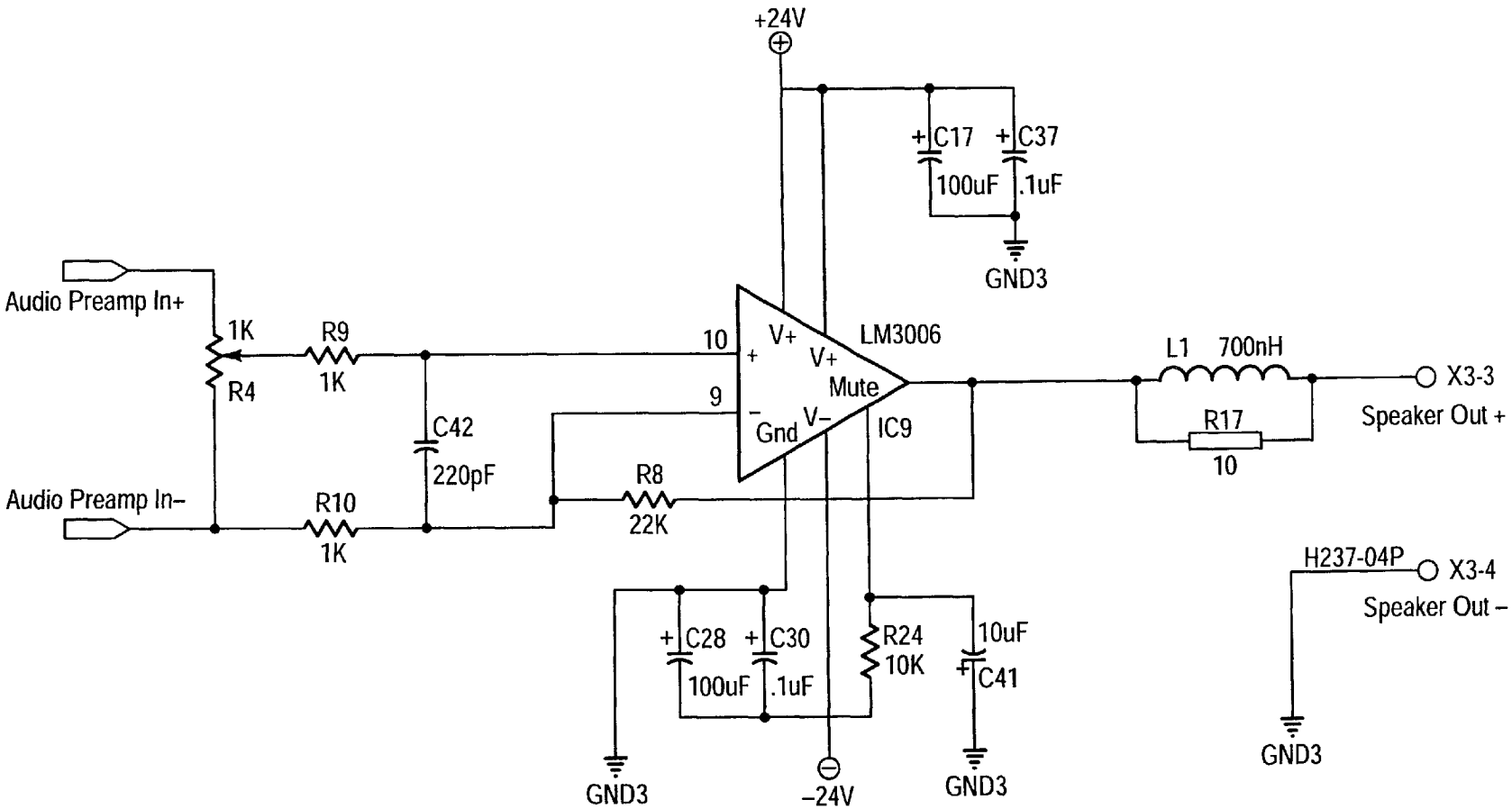
FIG. 10 is an electrical schematic diagram of a portion of the circuitry of the control unit.

Audio amplifier circuitry is shown in FIG. 10. A simple, single-chip audio amplifier is used to produce the output power required for a 115 dB audio signal. The LM3886 (IC9) is a 68-Watt power amplifier, although the controller will operate the amplifier at a lower output level (adjustable, typically 30–40 watts), to reduce thermal overload at high ambient temperatures. The output of the sound generator provides the input to the audio amplifier via R9 and R10. Potentiometer R4 allows volume adjustment. Resistor R8 provides negative feedback and prevents amplifier instability. Capacitor C42 prevents high-frequency instability and noise. The R-L combination (R17, L1) provides protection to the amplifier output stage in situations where large capacitive loads are being driven, such as when long cables are required between the amplifier and the speaker. R24 and C41 provide a "power-on mute" circuit which prevents speaker output for a short time after power-up which reduces speaker "popping". The remainder of the support components (C17, C28, C30 and C37) are bypass capacitors required to minimize noise in the audio output signal.

Figures 11A, 11B:
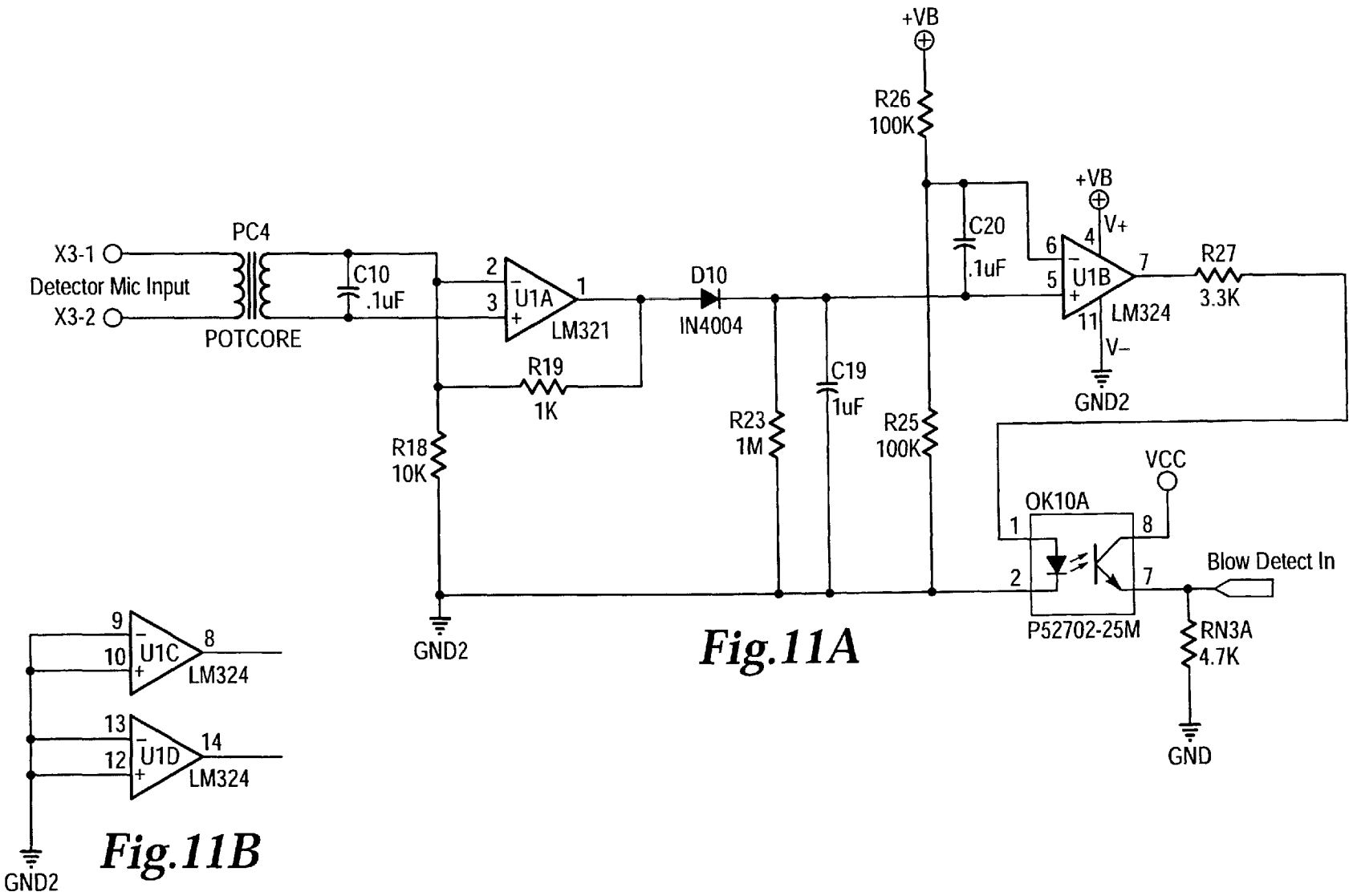
FIG. 11 is an electrical schematic diagram of a portion of the circuitry of the control unit.

Audio detection circuitry is shown in FIG. 11. The Audio Detector circuitry is used to verify that the horn is blowing when the controller drives the horn output. It is also used to verify that the horn is not blowing when the controller is not driving the output. The detector input is tied to a 8-ohm weatherproof speaker which is located near the horn output speaker. Transformer PC4 is used for impedence matching between the speaker and the detection circuitry. The detector input signal is attenuated by op-amp U1A. R18 and R19 are sized to provide a gain of 0.1 (attenuation). The output of the attenuated signal is half-wave rectified by D18 and is used to charge capacitor C19. As the detected volume level increases, the voltage across C19 rises. When the input signal is removed, C19 is discharged through resistor R23.

The op-amp U1B is configured as a comparitor. If the voltage over C19 rises high enough, the comparitor circuit is tripped and the output of U1B is energized. Resistors R25 and R26 are used to set the threshold level. The output of U1B drives optocoupler OK10A, whose logic-level output is used to drive the appropriate processor inputs. The other two op-amps (U1C and U1D) are not used and the inputs are grounded to prevent oscillations and current draws. To provide better vitality and redundancy, the audio detection circuitry shown in FIG. 11 may be duplicated using the remaining op-amps U1C and U1D. All circuitry of FIG. 11 is duplicated, and the Blow Detect In logic-level signal from each detection circuit is sent to one microprocessor. In the case of circuit failure of one detection circuit, the microprocessors will detect the inconsistent operation and generate a failure condition.

Figure 12:
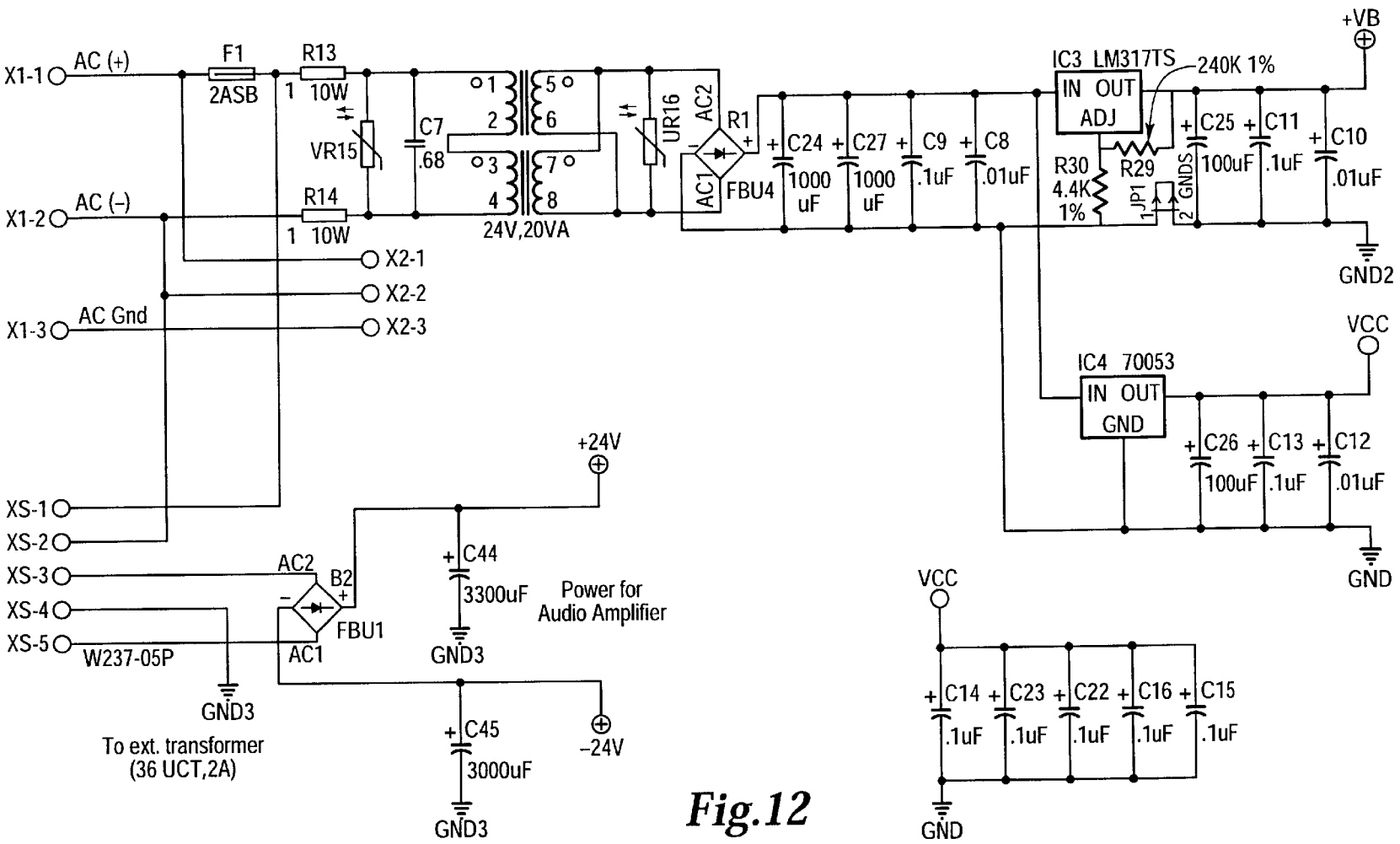
FIG. 12 is an electrical schematic diagram of a portion of the circuitry of the control unit.

Power supply circuitry is shown in FIG. 12. Due to the combination of circuits on the controller, a total of four separate voltages are required. These are +5 VDC regulated for logic-level circuitry, +24 VDC regulated for vital output generation, +24 VDC unregulated for the audio amplifier and −24 VDC unregulated for the audio amplifier. The AC power input is fused via V1 and protected against surges and spikes by R13, R14, and R15. Capacitor C7 provides high-frequency filtering of the AC input. Transformer T1 provides 24 VDC which is protected against any surges or spikes by R16.

The unfused AC (hot, neutral and ground) are also routed to the connector to feed any slave horn boards. The +5 VDC and +24 VDC regulated supplies may be powered from the single 24 VDC transformer. Bridge B1 provides full-wave rectification, and capacitors C8, C9, C24 and C27 smooth the voltage to an unregulated DC level. Regulator IC3 is an adjustable voltage regulator set to provide 24 VDC at a maximum of 1.5 amps. R29 and R30 set the voltage level to 24 VDC. C10, C11 and C25 provide filtering and smoothing of the 24 VDC regulated voltage. Regulator IC4 is a fixed 5 VDC regulator. Capacitors C12, C13 and C26 provide filtering and smoothing. Note that the 5 VDC and the 24 VDC regulated grounds are kept,separate on the board (GND and GND2, respectively). These grounds are tied together at a single point near the power supplies. By isolating the grounds on the board, the ground currents associated with the higher-current vital output drivers will not generate noise on the 5 VDC logic-level signals.

The audio amplifier requires large amounts of current at +24 VDC and −24 VDC. To minimize noise induced by high-current power draws, the audio amplifier power supply is kept separate from the remaining power supplies. Due to the size of the required transformer, it cannot be mounted on the circuit board itself. Connector X5 provides fused AC power to the external transformer and brings back the transformer secondary and center tap voltages. Bridge B2 provides full-wave rectification and capacitors C44 and C45 provide smooth, unregulated voltages for the amplifier. Note that the amplifier ground (GND3) is kept isolated from the regulated +5 VDC and +24 VDC grounds.

Figure 13:
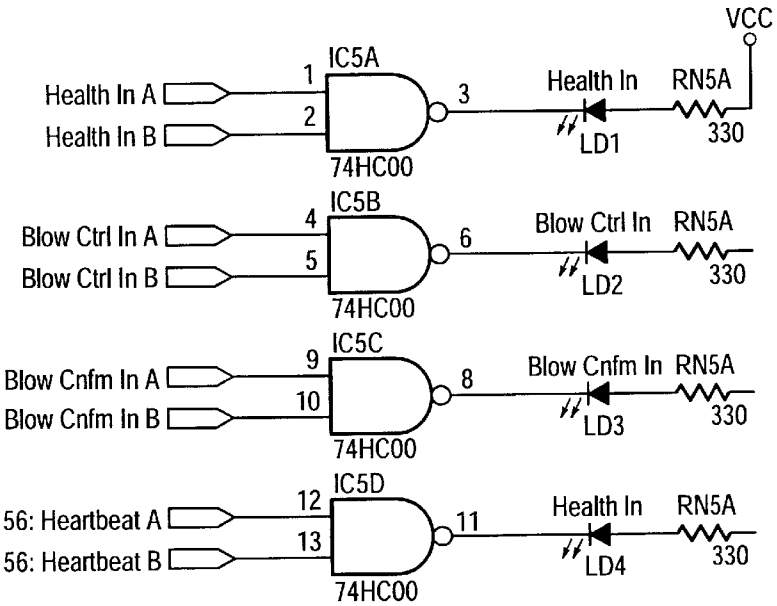
FIG. 13 is an electrical schematic diagram of a portion of the circuitry of the control unit.
Figure 13:
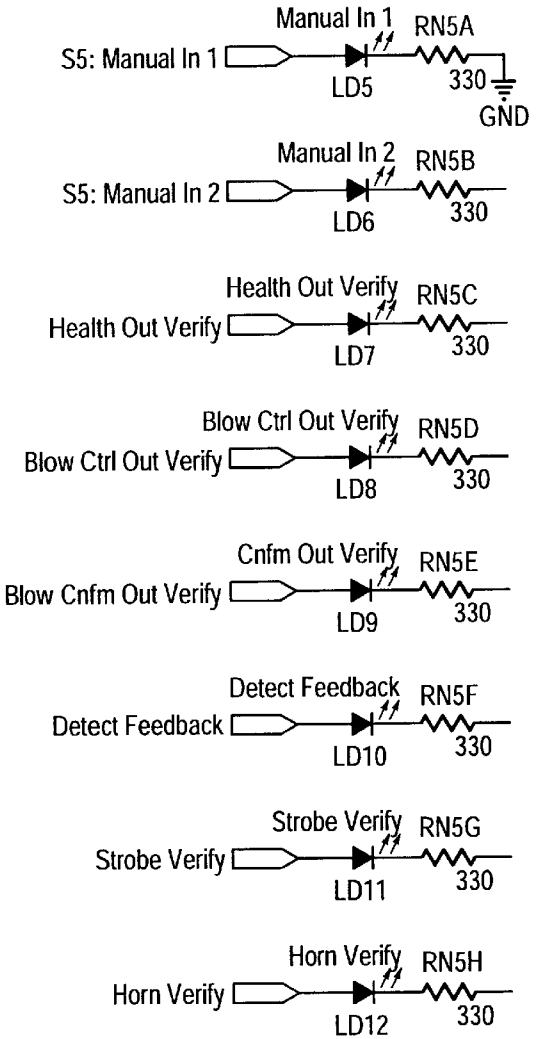

Indicator LED circuitry is shown in FIG. 13. Several indicators are included on the controller board to provide visual feedback regarding operation. These indicators represent various input, output and verification signals. The vital input indicators are illuminated only when both of the redundant vital input circuits are active. These signals are combined using NAND gate IC5. The vital input indicators are LD1 (Health In), LD2 (Blow Ctrl In) and LD3 (Blow Cnfm In). The heartbeat outputs of each processor chip-are synchronized during proper operation. A single heartbeat indicator is driven by combining the outputs of the processors via gate IC5D. LD4 is the heartbeat indicator. The remaining indicators are driven directly from the appropriate signals. These are: LD5 and LD6 (manual inputs 1 and 2); LD7, LD8 and LD9 (verification of the vital output circuitry); LD10 (detector feedback/blow detect); LD11 (strobe relay verify) and LD12 (horn verify).

The various connectors for use within the invention as illustrated throughout FIGS. 5–13 are grouped logically with the appropriate circuitry. Board connectors should be configured for ease of installation and for clarity in wiring. All connections are made using WAGO connectors that allow the combination of spring terminal wiring and plug-in operation. There are a total of five (5) connectors: Master (X1), Slave (X2), Speaker/Mic (X3), Manual Inputs (X4) and the audio power transformer (X5).

The Master connector (X1) is an 11-conductor WAGO used to interface to the control device. It contains the power (AC Hot/Neutral/Ground) input and the Blow Control input. It also provides the Health and Blow Control outputs and the Strobe contact closure circuit. Table 1 shows the X1 descriptions.

TABLE 1

Master Connector Pin Descriptions

| Pin | Signal Name | Description |
|---|---|---|
| X1-1 | AC Hot (in) | 120 VAC Power into the board |
| X1-2 | AC Neutral (in) | 120 VAC Power into the board |
| X1-3 | AC Ground (in) | 120 VAC Power into the board |
| X1-4<br>X1-5 | Health Vital + (out)<br>Health Vital − (out) | Health vital output. Active (+12 vdc) when board (and all slaves) are operating properly. |
| X1-6<br>X1-7 | Blow Cnfm Vital + (out)<br>Blow Cnfm Vital − (out) | Blow confirm output. Active (+12 vdc) when horn is blowing AND detector circuitry verifies output. (solid output - does not pulse with the blow pattern). |
| X1-8<br>X1-9 | Blow Ctrl Vital + (in)<br>Blow Ctrl Vital − (in) | Blow control input. When active (+12 vdc) horn blow is activated. Note: In Master mode, board generates blow pattern (2 long, short, long, pause) when this signal is solid. In Slave mode, horn blow follows this signal directly. |
| X1-10<br>X1-11 | Strobe Contact 1 (out)<br>Strobe Contact 2 (out) | Relay contact closure output. Active at same time as Blow Cnfm output signal. Contacts are non-polarized, AC or DC capable. |

Slave connector (X2) is a 9-conductor WAGO used to interface the horn board to a "Slave" horn board. It contains power (AC Hot/Neutral/Ground) output and the Blow Control output. It also contains vital Health and Blow Confirm inputs. Table 2 shows the X2 pin descriptions.

TABLE 2

Slave Connector Pin Descriptions

| Pin | Signal Name | Description |
|---|---|---|
| X2-1 | AC Hot (out) | (unfused) 120 VAC Power passed through the board (for slave use) |
| X2-2 | AC Neutral (out) | 120 VAC Power passed through the board (for slave use) |
| X2-3 | AC Ground (out) | 120 VAC Power passed through the board (for slave use) |
| X2-4<br>X2-5 | Health Vital + (in)<br>Health Vital − (in) | Health vital input. Active (+12 vdc) indicates slave(s) operating properly. |
| X2-6<br>X2-7 | Blow Cnfm Vital + (in)<br>Blow Cnfm Vital − (in) | Blow confirm input. Active (+12 vdc) indicates slave(s) horn blowing AND slave(s) detector circuitry verifies output. (Solid output - does not pulse with the blow pattern). |
| X2-8<br>X2-9 | Blow Ctrl Vital + (out)<br>Blow Ctrl Vital − (out) | Blow control out. Active (+12 vdc) when horn is blowing. Note: This output pulses with the blow pattern (2 long, short, long, pause). |

Table 3 shows the X3 pin descriptions. Speaker/Mis connector (X3) is a 4-conductor WAGO used to connect the board to the speaker and microphone.

TABLE 3

Detector/Mic Connector pin Descriptions

| Pin | Signal Name | Description |
|---|---|---|
| X3-1 | Detector Mic + (in) | Detector microphone input. |
| X3-2 | Detector Mic − (in) | Connects to the 8-ohm weatherproof speaker used to verify that the audio blow is driven properly. |
| X3-3 | Blow Speaker + (out) | Horn speaker output. Connects to the 4- or 8-ohm weatherproof speaker used to generate the audio blow. |
| X3-4 | Blow Speaker − (out) | |

Table 4 shows the X4 pin descriptions. Manual Input connector (X4) is a 3-conductor WAGO used to connect the manual input switches. It contains the two manual inputs and a common ground. Each input is activated by shorting the input signal to the ground.

TABLE 4

Manual Input Connector Pin Descriptions

| PIN | Signal Name | Description |
|---|---|---|
| X4-1 | Manual Input 1 (in) | Manual/Police Panel switch inputs. Input 1 for "Disable", input 2 for "Test" is a good combination. Can define these as desired. |
| X4-2 | Manual Input 2 (in) | |
| X4-3 | Manual Common GND | Common ground reference for inputs. NOTE: this is tied to Logic Ground, so the manual switch wiring MUST NOT BE TIED TO ANY EXTERNAL SIGNALS. Treat these as NEMA inputs and the NEMA LOGIC GROUND. |

Table 5 shows the X5 pin descriptions. Audio Power Transformer connector (X5) is a 5-conductor WAGO. It provides AC Hot and Neutral to the external transformer and brings back the transformer's secondaries and center tap.

TABLE 5

Audio Power Transformer Connector Pin Descriptions

| Pin | Signal Name | Description |
|---|---|---|
| X5-1 | AC Hot (out) | (fused!) 120 VAC Power to the audio power transformer's primary windings. |
| X5-2 | AC Neutral (out) | |
| X5-3 | AC secondary 1 (in) | Secondary from transformer. Two 18-volt sides and the center tap. (Transformer is a 36 volt center-tap, 2A secondary). |
| X5-4 | AC secondary C.T. (in) | |
| X5-5 | AC secondary 2 (in) | |

The controller is designed to allow multiple operating modes. The modes allow flexibility in system configuration. The mode is selected by the mode dip switches on the board. No other jumpers or board changes are required for selecting the desired mode. In Stand-Alone mode, the controller responds to a steady-state vital input activation by blowing the horn in the programmed pattern (long-long-short-long-pause, repeat). If the detection circuitry verifies the horn's audio output, a steady-state vital output is activated along with a relay contact closure output. Stand-Alone mode is used when the horns are not daisy-chained together. Such as either a single horn is being used, or horn placement is such that it is most efficient to wire each horn to a control cabinet or bungalow separately. If wired separately, a "vital AND" gate is used in the control cabinet or bungalow to verify the proper operation of all horns.

When in Stand-Alone mode, the controller X2 connector is not used and any input signals are ignored. The Health and Horn Confirm outputs are generated based on the operational status of the single board.

Master mode is very similar to Stand-Alone mode, with the ability to drive additional "slave" boards via the X2 connector. When a master board receives the steady-state vital input activation, it blows its horn in the programmed pattern (long-long-short-long-pause, repeat). In addition, it drives the Horn Control vital output on the X2 connector in the same programmed pattern. This signal is used by slave boards to blow additional horns. When in Master mode, the controller monitors the Health and Horn Confirm signal inputs on the X2 connector. The corresponding outputs on the X1 connector are activated only when the on-board operation is correct and the inputs from the X2 connector are active. In this way, any failed board will result in a failure condition generated by the Master board.

Slave mode differs from Master mode in that the horn blow output is controlled directly from the horn control input. The slave board does not generate the programmed pattern. This is so that all horns blow simultaneously. If each board generated its own blow pattern, the horns may get "out of sync," possibly creating the effect of multiple trains and/or reduced volume levels. By having the pattern generated by a single Master board, all horns are synchronized for maximum effect. Slave mode, like Master mode, results in the activation of Health and Blow Confirm vital outputs when the board is operating properly and the detector verifies the proper "blow" operation. Slave Pass-Through mode generates these outputs only if the on-board operation is correct AND the inputs from the X2 connector are active. The Slave pass-through mode allows any number of slave boards to be daisy-chained off the master board. Each board relays the Health and Blow Confirm signals only if that board and all subsequent boards are operational.

The Slave End Unit mode is identical to Slave Pass-Through mode, except it ignores any signals on the X2 connector. This mode is used for the last slave on the daisy chain. It precludes the need to tie the Health and Blow Confirm vital inputs on X2 active for proper operation.

Whereas the invention has been shown and described in connection with the preferred embodiment thereof, it will be understood that many modifications, substitutions and additions may be made which are within the intended broad scope of the appended claims. There has therefore been shown and described an improved railroad crossing warning system which accomplishes at least all of the above stated advantages.

What is claimed is:

1. A warning system for the intersection of a railroad track and roadway being generally transverse to a railroad track, comprising:

an audible alarm located at the intersection that produces a directional audible signal in opposing directions along a roadway;

a visual indicator co-located with the audible alarm producing a visual signal to an approaching track-based vehicle indicating the activation of the audible alarm at predefined operational levels; and a controller connected to the audible alarm and the visual indicator, the controller comprising inputs for receiving signals from transducers placed at predetermined locations along the railroad track, wherein the transducers detect the approach of the track-based vehicle towards the intersection and for activating the alarm in response to the detection of the signals, the controller further including a monitoring device that monitors the operation of the alarm at predefined operational levels and transmits a signal to the visual indicator indicative thereof, a detection devise that detects the proper operation of the visual indicator and a recording device that records system operation.

2. The warning system of claim 1 wherein the controller further comprises a plurality of inputs for managing a plurality of independent transducer triggering events.

3. The warning system of claim 2 wherein the controller, through the plurality of inputs, provides multiple railroad track monitoring capabilities.

4. The warning system of claim 2 wherein the controller generates audible signals in response to the independent transducer triggering events.

5. The warning system of claim 1, wherein the audible alarm, visual indicator and controller are integrated into an alarm assembly, the alarm assembly mountable at the intersection such that the alarm and the visual indicator are separately orientable to direct the audible signals along the roadway, generally transverse to the railroad track, and the visual indicator along the railroad track, generally towards the direction of approaching track-based vehicles.

6. The warning system of claim 5, wherein the controller generates a predetermined sequence of horn blasts upon activation of the alarm.

7. The warning system of claim 6, wherein the sequence of horn blast resembles the sound of a train horn.

8. The warning system of claim 1, wherein the visual indicator includes a masking device that prevents viewing of the visual indicator in directions transverse to the railroad track.

9. The warning system of claim 1, wherein the monitoring device detects the decibel level of the alarm and wherein the controller transmits a signal to the visual indicator only upon detection of an audible signal above a predetermined decibel level.

10. The warning system of claim 9, wherein the audible signal is a recorded sound of a train horn.

11. An advanced warning system for the intersection of a railroad track and roadway that is generally transverse to the railroad track, comprising:

an audible alarm located at the intersection that produces a directional audible signal in opposing directions along a roadway;

a sound detector for monitoring the audible alarm;

a visual indicator co-located with the audible alarm producing a visual signal to an approaching track-based vehicle of the successful activation of the audible alarm; and a controller connected to the audible alarm, sound detector and the visual indicator, the controller comprising a plurality of inputs for receiving signals from plural transducers located along the railroad track, wherein the transducers detect the approach of the track-based vehicle towards the intersection at predetermined locations along the railroad track, and for activating the alarm in response to the detection of the signals, the controller further including means for monitoring the plurality of inputs, the sound detector and the visual indicator, means for actuating the audible alarm at predefined operational levels based on transducer input to the controller, means for transmitting a signal to the visual indicator in response to successful activation of the audible alarm as indicated by the sound detector, means for detecting the proper operation of the visual indicator and means for recording system operation.

12. The warning system of claim 11, wherein the successful activation of the audible alarm is at predefined operational levels according to transducer inputs to the controller.

13. The warning system of claim 12 wherein the predefined operational levels are provided to the alarm from memory through the controller based on transducer triggering events provided to the controller.

14. The warning system of claim 11 wherein the controller, through the plurality of inputs, provides monitoring capabilities for more than one set of railroad tracks.

15. The warning system of claim 11 wherein the controller generates audible signals in response to the independent transducer triggering events.

16. The warning system of claim 11, wherein the audible alarm, visual indicator, sound detector, and controller are integrated into an alarm assembly, the alarm assembly mountable at the intersection such that the alarm and the visual indicator are separately orientable to direct the audible signals along the roadway, generally transverse to the railroad track, and the visual indicator along the railroad track, generally towards the direction of approaching tracked vehicles.

17. The warning system of claim 11, wherein the visual indicator includes a means for masking the visual display from viewing in directions transverse to the railroad track.

18. The warning system of claim 11, wherein the sound detector provides to the controller decibel levels of the audible alarm, wherein the controller, based on the levels, transmits a signal to the visual indicator only upon detection of an audible signal above predefined decibel levels.

19. The warning system of claim 18 wherein the controller automatically adjusts the audible alarm to produce audible signals at the predefined decibel levels.

20. The warning system of claim 11, wherein the controller includes a means for producing a predetermined sequence of horn blasts upon activation of the alarm.

21. The warning system of claim 20, wherein the sequence of horn blasts resembles the sound of a train horn.

22. The warning system of claim 21, wherein the audible signal is a recorded sound of a train horn.

23. A method of providing advanced audible warning at the intersection of a railroad track and roadway, comprising:

monitoring a plurality of controller inputs from remote transducer inputs, wherein the remote transducer inputs originate from a plurality of transducers located along the railroad track;

actuating an audible alarm at predefined operational levels based on transducer input to the controller, the input indicating the approach of a track-based vehicle towards the intersection;

transmitting a signal to a visual indicator in response to activation of the audible alarm at predefined decibel levels; and recording system operation.

24. The method of claim 23 wherein the audible alarm is produced by a directional audible alarm signal generated in opposing directions along the roadway, the roadway being generally transverse to the railroad track.

25. The method of claim 23 wherein the step of transmitting a signal to the visual indicator further comprises providing a response to the activation of the audible alarm at predefined decibel levels according to measurements recorded by a sound detector monitoring the audible alarm.

26. The method of claim 23 wherein the visual indicator is co-located with the audible alarm for visually indicating to the approaching track-based vehicle of the successful activation of the audible alarm.

27. The method of claim 26, wherein the audible alarm is actuated at predefined operational levels based on transducer inputs to the controller.

28. The method of claim 23 wherein audible alarm activation and visual indicator functions are recorded.

* * * * *